United States Patent [19]

Keele, Jr.

[11] 4,308,932

[45] Jan. 5, 1982

[54] LOUDSPEAKER HORN

[75] Inventor: D. Broadus Keele, Jr., Camarillo, Calif.

[73] Assignee: James B. Lansing Sound, Inc. ("JBL"), Northridge, Calif.

[21] Appl. No.: 147,014

[22] Filed: May 6, 1980

[51] Int. Cl.[3] ..... G10K 11/00

[52] U.S. Cl. ..... 181/187; 181/192

[58] Field of Search ..... 181/187–188, 181/192–195

[56] References Cited

U.S. PATENT DOCUMENTS

| | | | |
|---|---|---|---|
| 2,338,262 | 1/1944 | Salmon | 181/192 |
| 2,537,141 | 1/1951 | Klipsch | 181/187 |
| 2,690,231 | 9/1954 | Levy et al. | 181/192 |
| 4,071,112 | 1/1978 | Keele, Jr. | 181/187 |
| 4,171,734 | 10/1979 | Peveto et al. | 181/192 |
| 4,187,926 | 2/1980 | Henricksen et al. | 181/192 |

FOREIGN PATENT DOCUMENTS

| | | | |
|---|---|---|---|
| 829329 | 6/1938 | France | 181/192 |

*Primary Examiner*—Lawrence R. Franklin
*Assistant Examiner*—Thomas H. Tarcza
*Attorney, Agent, or Firm*—Lyon & Lyon

[57] ABSTRACT

A loudspeaker horn having improving directivity has a pair of smoothly flared vertical sidewalls joined to a pair of smoothly flared horizontal sidewalls. In an exemplary embodiment, one pair of sidewalls is generated as a surface of revolution, with the curvature of the surface being defined by a power series formula. The contour of the remaining pair of sidewalls is also defined by the power series formula, although different constants may be used. The vertical and horizontal sidewalls are separately defined and are substantially congruent at the rectangular or square mouth. In the exemplary embodiment, the gap formed at the back of one of the pairs of sidewalls is connected to the throat formed at the back of the other pair of sidewalls by a connecting section having an arcuate area which monotonically increases from the throat to the gap.

14 Claims, 6 Drawing Figures

LOUDSPEAKER HORN

FIELD OF THE INVENTION

The present invention relates generally to loudspeaker horns, and more particularly to loudspeaker horns employing outwardly flaring sidewalls and a substantially rectangular mouth.

BACKGROUND OF THE INVENTION

Loudspeaker horns of the general type disclosed here are designed to provide an acoustical output of constant directivity and beamwidth as a function of frequency and to provide a constant acoustic load to the driver. However, it is well recognized that a horn can only offer directivity control down to frequencies at which the wavelength is comparable to horn mouth size. In addition, maintaining directivity control at higher frequencies has also proven difficult with many prior art designs due to narrowing at the midrange and high frequencies, polar lobing, or other deficiencies.

An early horn design is the conical horn, such as found on the early phonographs or victrolas. However, the conical horn exhibited poor low-frequency response as well as midrange narrowing and other deficiencies. Another well known loudspeaker horn design is the radial-sectoral horn, which also exhibited midrange narrowing of beamwidth and polar lobing, although somewhat better low frequency performance was provided. Another well known horn design is shown in U.S. Pat. No. 2,537,141, which discloses a multi-cellular radial sectoral horn. This design also suffered from the deficiencies noted above.

Another loudspeaker horn design is shown in U.S. Pat. No. 4,071,112, by the present inventor. The horn disclosed in the '112 patent employs a throat section having an exponentially increasing area coupled to a mouth section having an area which increases conically. By providing additional flaring at the mouth, the problem of midrange narrowing was lessened; thus, beamwidth (the included angle between the −6 db points in a polar plot) is improved. However, other characteristics of the horn could still be improved.

Still another attempt to design the ideal horn is shown in U.S. Pat. No. 4,187,926, which uses substantially the same approach as found in U.S. Pat. No. 4,071,112. The design disclosed by the '926 patent involves the use of a first pair of sidewalls extending from the driver to the mouth at a predetermined angle, and another pair of sidewalls which are parallel at the throat and then flare to form a bell section at a second fixed angle. The two pairs of sidewalls are joined at the mouth of the horn. This design also suffers from poor low frequency response and nonuniform sound dispersion at some frequencies.

The present invention overcomes or improves upon many of the limitations encountered with the prior loudspeaker horn designs discussed above. In accordance with the present invention, a horn is comprised of a pair of vertical sidewalls and a pair of horizontal sidewalls disposed at right angles to one another, one of which is defined by a surface of revolution. The curvature of the surface of revolution, and the contour of the remaining pair of sidewalls, is defined by a power series formula which includes factors determined by the desired dispersion angle, low frequency limit, throat diameter, and rate of flare. Because the vertical dispersion angle and other characteristics may differ from the horizontal characteristics, the curvature of the vertical sidewalls is separately defined from the horizontal sidewalls.

Once the above characteristics are selected, other dimensions of the loudspeaker horn are computed. Thus the horn throat included angle, horn length, and horn mouth width are calculated and used to provide the factors for the power series formula described above. The process is repeated for the second pair of sidewalls, using the geometrics and factors which are appropriate for the desired dispersion angle in the second plane. The two pairs of sidewalls are then joined congruently at the mouth and the gap formed by one of the pairs of sidewalls is connected to the throat of the horn by means of a connecting section.

It is therefore one object of the present invention to provide an improved loudspeaker horn.

It is another object of the present invention to provide a loudspeaker horn having directional characteristics which are substantially constant with frequency.

These and other objects of the present invention can better be appreciated from the following detailed description in which FIG. 1 is a perspective view of the loudspeaker horn constructed in accordance with the present invention.

Figure 4A:
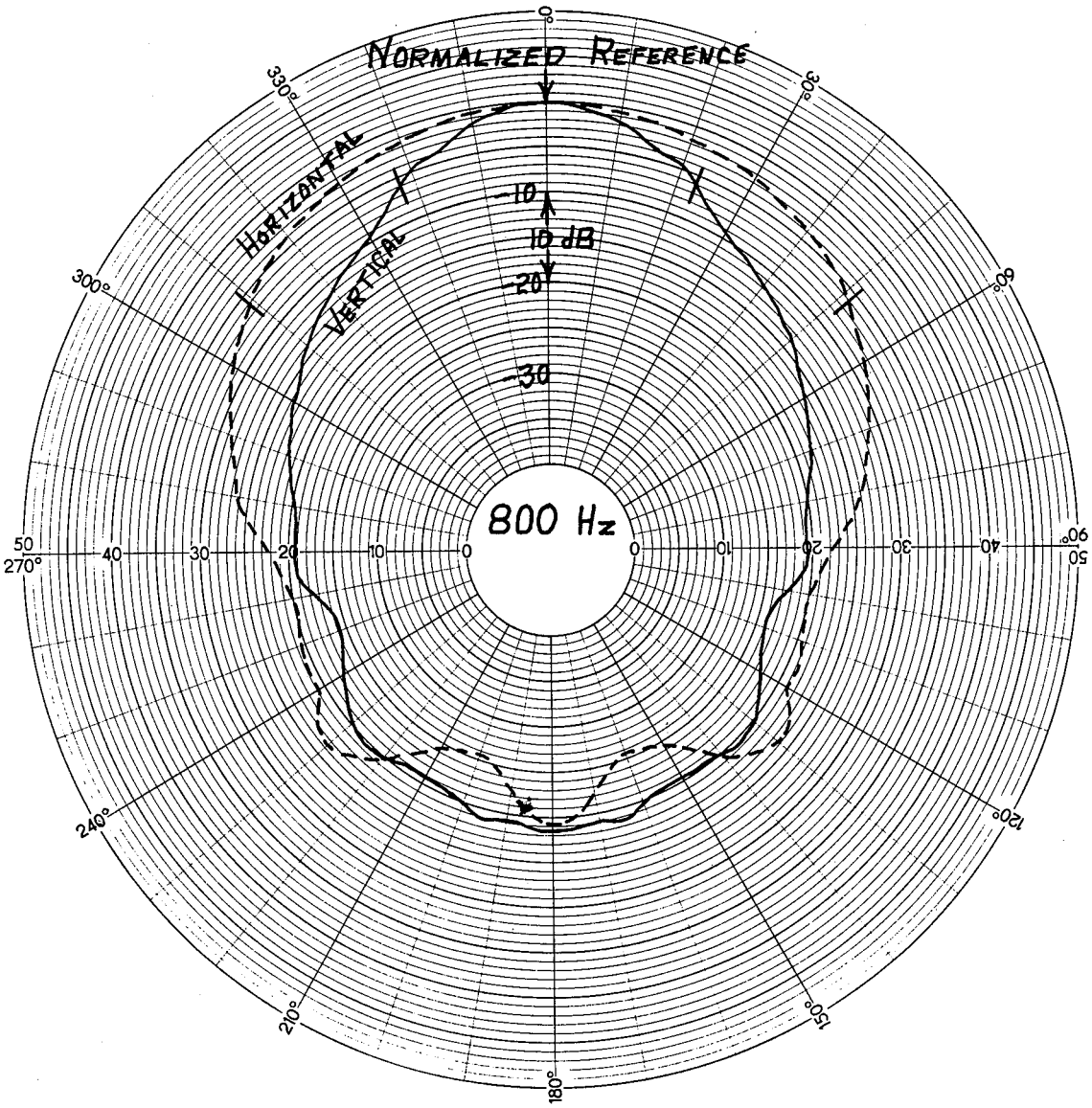
Figure 4B:
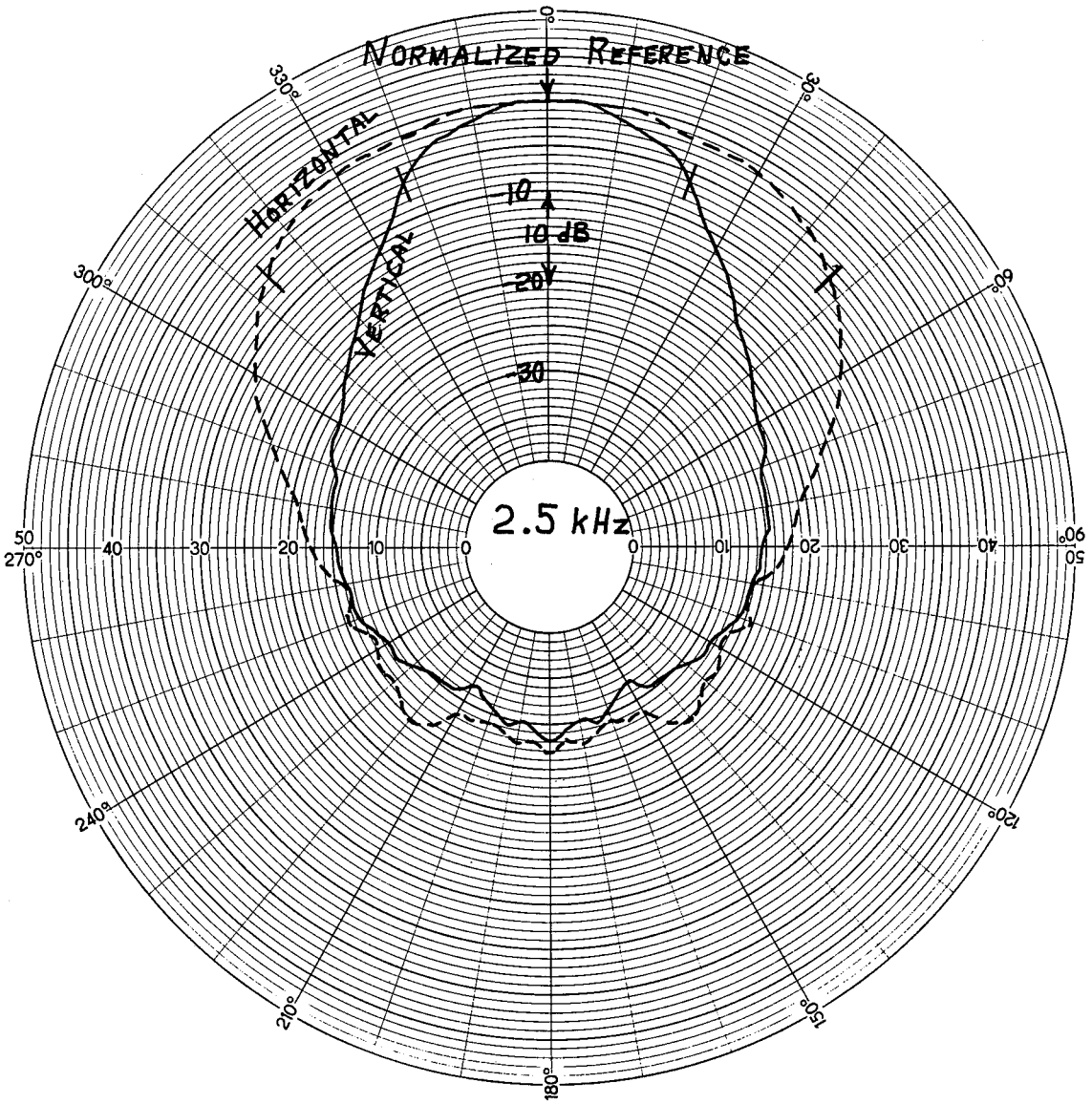
Figure 4C:
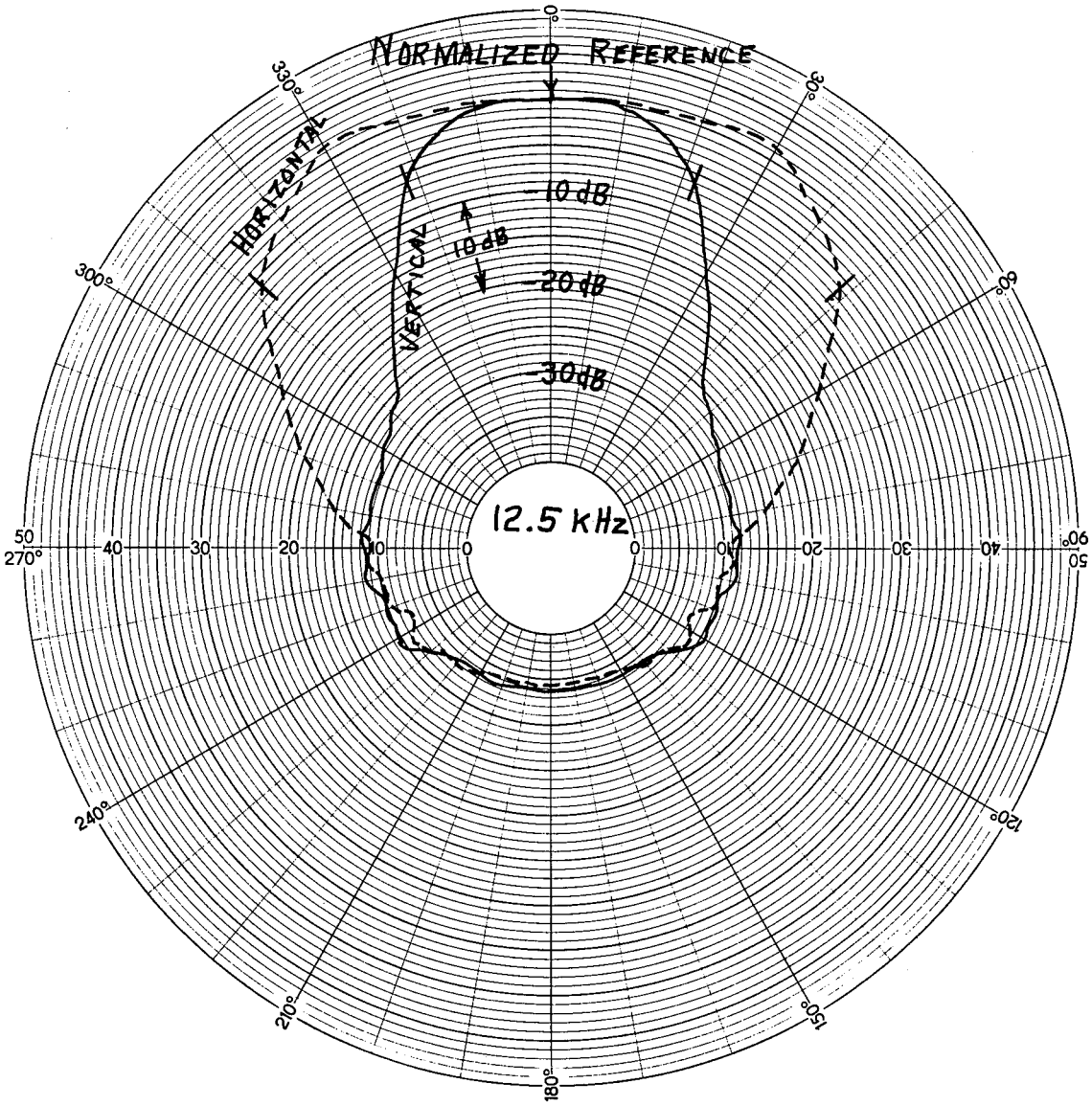

FIGS. 4*a–c* are polar diagrams showing the directional characteristics of the horn of the present invention at representative frequencies.

Figure 1:
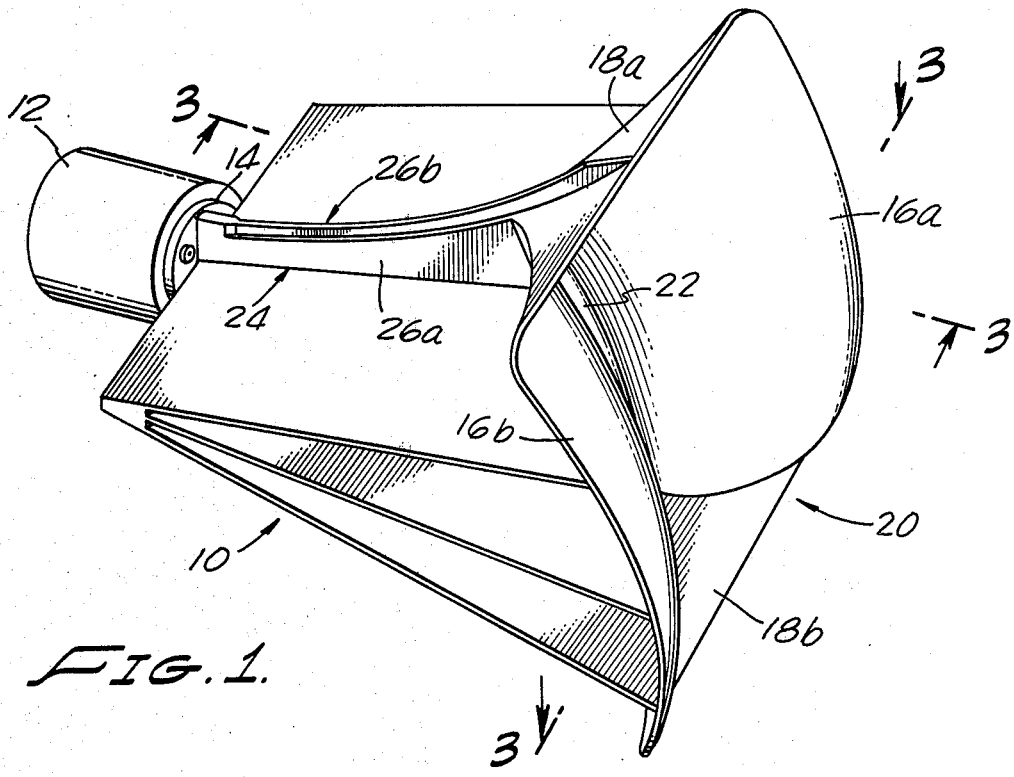

Referring first to FIG. 1, a loudspeaker horn 10 constructed in accordance with the present invention is shown in perspective view. A conventional driver 12 is affixed to the horn 10 at the throat 14 of the horn. The horn 10 includes a pair of smoothly curving horizontal sidewalls 16*a–b*, and a pair of smoothly curving vertical sidewalls 18*a–b* which join at a mouth 20. The mouth 20 in the exemplary embodiment shown is square; the mouth in other embodiments is substantially rectangular with the perimeter of the mouth being defined by the selected beamwidth and low-frequency limits. Because the flare angle for the horizontal sidewalls 16*a–b* is greater than that for the vertical sidewalls 18*a–b*, a gap 22 is formed at the back of the horizontal sidewalls which is connected to the throat 14 by a connecting section 24 formed from another pair of sidewalls 26*a–b*.

Figure 2:
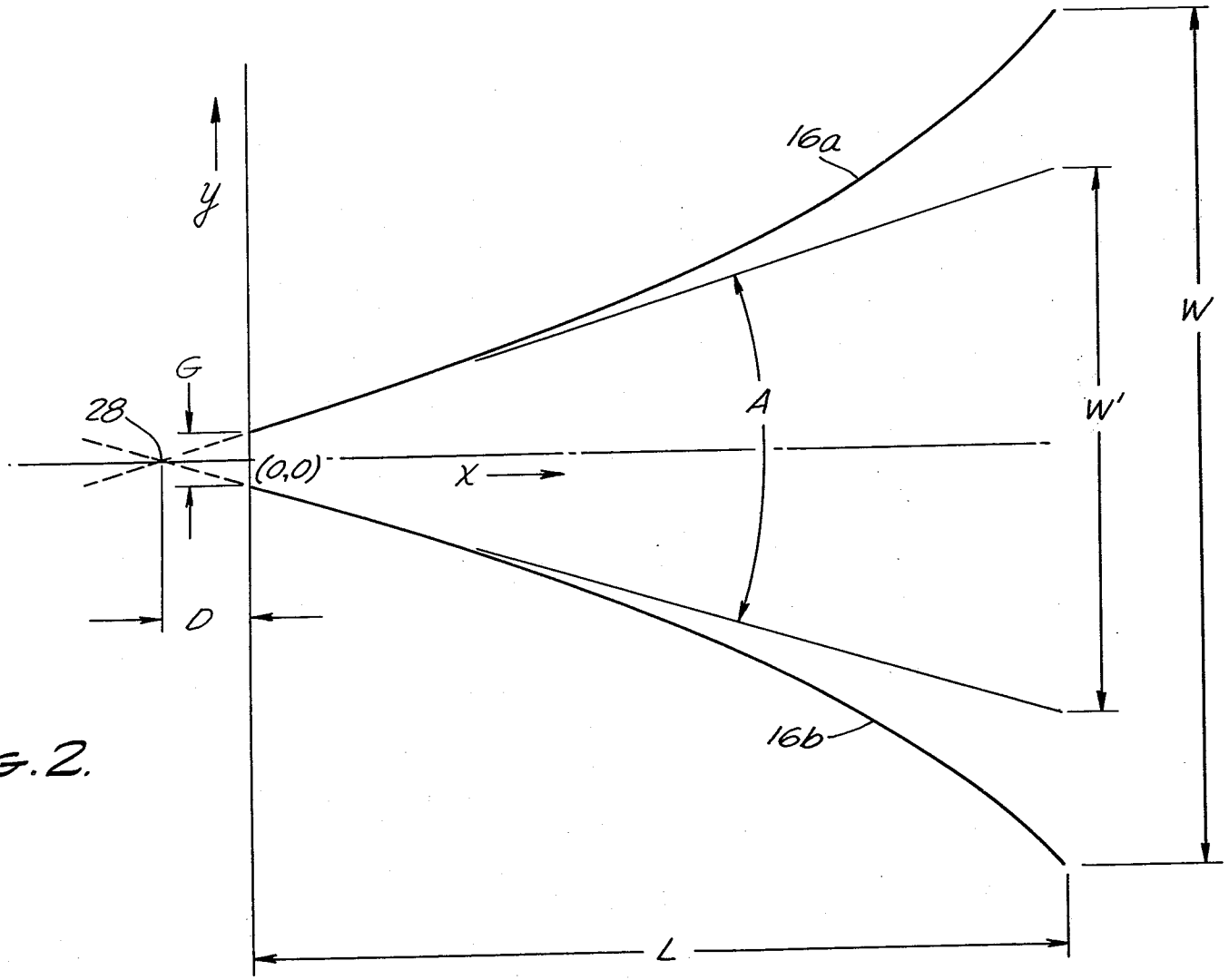
FIG. 2 is a schematic diagram showing the profile of an exemplary sidewall contour together with the dimensions necessary for a determination of the factors used in the power series equation of the present invention.

Referring now to FIG. 2, the contour of one pair of sidewalls, for example the sidewalls 16*a–b* of FIG. 1, is depicted schematically together with the dimensions necessary for selecting the constants in the power series $$y=a+bx+cx^n, \qquad \text{(Eq. 1)}$$

which defines the curvature of the sidewalls as explained in greater detail hereinafter.

A factor to be initially selected is the desired coverage angle, or beamwidth B. Although a wide range of coverage angles is acceptable, typical horizontal and vertical coverage angles are 40°×20°, 60°×40°, and 90°×40°. Also, a low frequency limit in Hertz, F, must be selected. Such low frequency limits are typically on the order of 400 Hz. In addition, a desired horn throat diameter G, is selected. Finally, an exponential flare rate factor, n, is selected in a manner discussed in greater detail hereinafter.

Once the factors discussed above are selected, other dimensions of the horn can be computed. The horn throat included angle in degrees, A, is calculated from the beamwidth in degrees, B, and has been empirically determined to be on the order of ninety percent of beamwidth. Thus the prepared relationship between horn throat included angle and beamwidth may be expressed as:

$$A=0.9B$$

Also, total horn mouth width in meters, W, must be computed. Mouth width has been related to horn throat included angle and low frequency limit by an empirically derived relationship, expressed as:

$$W=K/A.F$$

where K is a constant and has been empirically determined to be on the order of 25,000 m-degrees-Hertz. It is also necessary to determine the horn mouth dimension (in meters) for straight side walls, W', in addition to horn mouth width, W. It has been previously determined that a preferred relationship is $$W'=W/1.5$$

which has been found empirically to optimize the coverage characteristics of the horn. Once the mouth dimension W' is known, the horn length, L, can be calculated according to the equation $$L=\frac{W'/2}{\text{Tan }(A/2)}-D;$$

in which D is the distance from the back of the horn to the intersection of the lines defining the included angle A.

Once the foregoing calculations are complete, the constants a, b and c for the power series given in equation (1) above can be determined. The factor a is one-half the throat height, or $$a=G/2.$$

Likewise, the factor b is related to the horn throat included angle as $$b=\tan\ (A/2).$$

Since the power series given above results in y being equal to W/2 when X is equal to L, the factor C can be computed from the equation $$c=\frac{W/2-b\cdot L-a}{L^n}$$

This yields all of the factors of the power series. It has been discovered that the flaring factor, n, preferably falls within the range of four to six. Preferably, but not necessarily, the larger values of n are associated with the larger cover angles (B), and smaller values of n are associated with smaller coverage angles.

Figure 3:
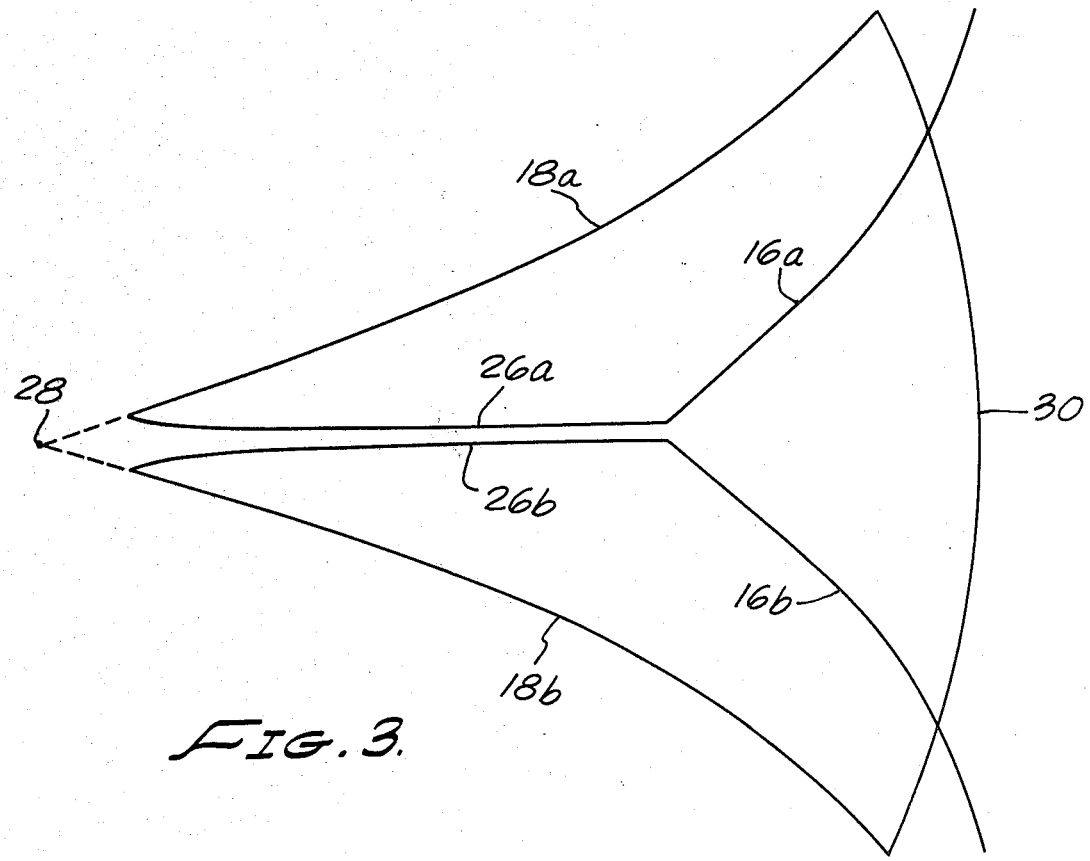
FIG. 3 is a schematic representation of the profiles of both sidewall pairs of a horn constructed in accordance with the present invention in which the one of the sidewall pairs has been rotated 90° for ease of illustration.

Once the constants have been computed for the power series equation given above for the first pair of sidewalls, the same procedure is used to determine the constants a, b and c for the remaining pair of sidewalls. It will be appreciated that the contours resulting from the two power series will be smoothly flaring and will continuously diverge from the throat of each sidewall pair to the mouth. However, because the horizontal coverage angle frequently differs from the vertical coverage angle, the flare rates for the two pairs of sidewalls may differ substantially as can be seen from FIG. 3. FIG. 3 schematically depicts the curvature of both the vertical sidewall pair 18*a–b* and the horizontal sidewall pairs 16*a–b*, *'as seen in a bisecting plane; it will be appreciated that the sidewall pair 18a–b* has been rotated 90° about the centerline for ease of illustration.

Because of the need for both pairs of sidewalls to smoothly join at the mouth 20, the throat, or gap 22, of the sidewalls 16*a–b* may not be congruent with the throat 14 of the sidewalls 18*a–b*. For such designs, the gap 22 of the sidewalls 16*a–b* is joined to the throat of the sidewalls 18*a–b* by the sidewalls 26*a–b*, which form the coupling or connecting section 24. The area of the coupling section in the exemplary embodiment diverges from the throat to the gap with an exponential increase in area, and in general preferably exhibits a monotonic increase from the throat to the gap.

As previously noted, the sidewalls 16*a–b* are generated as surfaces of revolution with the curvature of the surface of revolution being defined by the power series formula given above. In addition, the contour of the sidewalls 18*a–b* is defined by the power series given above. The manner in which the surface is generated can best be understood from FIG. 3. As noted above, FIG. 3 schematically depicts the curvature of both the vertical sidewalls 18*a–b* and the horizontal sidewalls 16*a–b*, as well as the connecting section sidewalls 26*a–b*, as seen in a plane which bisects each pair of sidewalls. The sidewalls 16*a–b* and 26*a–b* have been rotated 90° in FIG. 3 for ease of illustration.

To generate the surface of revolution, the curvature of the sidewalls 18*a–b* is extended to the left until a vertex is formed. This point, which is to the left of the origin as shown in FIG. 2, forms the center of rotation, 28 and the radius, R, is the distance from the center of rotation 28 to the arc 30. The sidewalls 16*a–b* and 26*a–b* are then restored to their proper orientation (rotated 90°), and swept around the center 28 in a circle of radius R to form a surface of revolution. The sidewalls 18*a–b* are then overlayed on the surface of revolution and sectioned therefrom. The sidewalls 16*a–b* and 26*a–b* are formed by the surface of revolution itself. It will be understood by those skilled in the art that the connecting section 24 is modified in a conventional manner to connect a typically circular throat 14 to a substantially rectangular gap 22 over the distance from the throat to the gap.

As an example of a loudspeaker horn constructed in accordance with the present invention, the following table is provided in which both vertical and sidewall contours are defined:

| | | |
|---|---|---|
| Hor. Coverage Angle ($A_h$) | = | 80° |
| Vert. Coverage Angle ($A_v$) | = | 36° |
| Mouth Height ($W_v$) | = | 780 mm |
| Mouth Width ($W_h$) | = | 780 mm |
| Length (L) | = | 815.1 mm |
| Throat Diameter (G) | = | 48.8 mm |

-continued

| | | |
|---|---|---|
| Gap Width | = | 18.0 mm |
| Vert. Exp ($N_v$) | = | 4.0 |
| Horiz. Exp. ($N_h$) | = | 5.5 |
| Radius = O at x | = | 125.0 mm |
| Gap to Mouth distance | = | 299.1 mm |
| Throat to Gap distance | = | 516 mm |

FIGS. 4*a*, 4*b* and 4*c* are polar diagrams showing the directional characteristics of a horn built according to the present invention, in which vertical characteristics are shown by a solid line and horizontal characteristics are shown by a dashed line. FIG. 4*a* shows such characteristics at 800 hertz; FIG. 4*b* at 2.5 khz; and FIG. 4*c* at 12.5 khz.

Having fully described one embodiment of the present invention, it is to be understood that numerous alternatives and equivalents which do not depart from the spirit of the present invention such as other forms of exponential terms will be apparent to those skilled in the art given the teachings herein. Such alternatives and equivalents are intended to be included with the scope of the present invention and the appended claims.

What is claimed is:

1. A loudspeaker horn comprising a first pair of sidewalls having a contour defined by an equation having a constant term, a linear term and an exponential term, each of said terms including a non-zero constant, a second pair of sidewalls disposed substantially ninety degrees to said first pair of sidewalls and having a contour defined by an equation of the same form as the equation defining the first pair of sidewalls, said first and second pairs of sidewalls being substantially congruent at one end to form a mouth, and said second pair of sidewalls forming a gap at the remaining end thereof, and a connecting section connecting the gap formed by the second pair of sidewalls to the remaining end of the first pair of sidewalls to form a throat, said throat being adapted to be connected to a driver, said first pair of sidewalls being smoothly joined to said second pair of sidewalls and said connecting section.

2. The loudspeaker horn of claim 1 wherein said equation includes terms having constants which are representative of coverage angle, low frequency limit, horn throat diameter and flare rate.

3. The loudspeaker horn of claim 1 wherein the cross-sectional area of the connecting section continuously diverges from the throat to the gap.

4. The loudspeaker horn of claim 2 wherein said factor representative of flare rate is in the range of 4 to 6.

5. A loudspeaker horn comprising first and second pairs of sidewalls, the contours of each pair of sidewalls being defined by the equation $$y=a+bx+cx^n$$

wherein a, b, c and n are non-zero constants, x is the linear distance from the throat along the acoustic axis and y is the displacement from said axis said first pair of sidewalls having a first set of constants and said second pair of sidewalls having a second set of constants, one end of said first pair of sidewalls being joined to one end of said second pair of sidewalls to form a rectangular mouth, and the remaining end of said first pair of sidewalls being joined to the remaining end of the second pair of sidewalls by a connecting section to form a throat.

6. The loudspeaker horn of claim 5 wherein the constant a is determined by throat height, the constant b is determined by throat included angle, and the constant n is in the range of 4–6, and the constant c is determined by coverage angle, horn length, throat height and included angle, and flare constant.

7. The loudspeaker horn of claim 6 in which the value of n increases as coverage angle increases.

8. A loudspeaker horn comprising a first pair of sidewalls, the contour of said sidewalls in a bisecting plane being defined by an equation having a constant term, a linear term and a an exponential term, each of said terms including a non-zero constant a first end of said pair of sidewalls forming a mouth and the remaining end forming a gap, a second pair of sidewalls, the contour of said sidewalls in a bisecting plane being defined by an equation having a constant term, a linear term and an exponential term, each of said terms including a non-zero constant a first end of said pair of sidewalls forming a mouth and the remaining end forming a gap, and said second pair of sidewalls disposed at substantially ninety degrees with respect to said first pair of sidewalls, the mouth of said first pair of sidewalls being joined directly to the mouth of said second pair of sidewalls, and the gap and throat being connected.

9. A loudspeaker horn as in claim 8 wherein said second pair of sidewalls is generated as a surface of revolution having said contour.

10. A loudspeaker as in claim 9 wherein said gap is coupled to said throat by a connecting section having an area which monotonically increases from the throat to the gap.

11. A loudspeaker horn as in claim 10 wherein said connecting section exhibits an exponential increase in area from the throat to the gap.

12. A loudspeaker horn as in claim 8 wherein said equation is of the form $$y=a+bx+cx^n.$$

13. A loudspeaker horn as in claim 8 wherein said equation is of the form $$y=a+bx+ce^{xn}.$$

14. A loudspeaker horn as in claim 12 wherein the factor n is in the range of 2 to 8.

* * * * *